US006202391B1

(12) United States Patent
Stovin et al.

(10) Patent No.: US 6,202,391 B1
(45) Date of Patent: Mar. 20, 2001

(54) SIDING SORTING AND PACKING ARRANGEMENT

(75) Inventors: Garfield Stovin, Kansas City; Steve Miner, Independence; Robert Szabo, Kansas City; Michael Buls, Kansas City; Roger D. Gubbels, Kansas City, all of MO (US)

(73) Assignee: K-Ter Imagineering, Inc., Kansas City, MO (US)

( * ) Notice: Subject to any disclaimer, the term of this patent is extended or adjusted under 35 U.S.C. 154(b) by 0 days.

(21) Appl. No.: 08/982,616

(22) Filed: Dec. 2, 1997

(51) Int. Cl.[7] ..... B65B 57/00

(52) U.S. Cl. ..... 53/564; 53/382.1; 53/387.2; 53/376.7

(58) Field of Search ..... 53/544, 564, 382.1, 53/383.1, 387.2, 382.2, 382.3, 376.7, 377.2, 377.4, 376.5, 376.4

(56) References Cited

U.S. PATENT DOCUMENTS 3,662,516 * 5/1972 Wiseman ..... 53/382.3
4,191,005 * 3/1980 Vinoskey ..... 53/382.3
4,569,182 * 2/1986 Leuvering ..... 53/383.1
4,778,554 * 10/1988 Doman ..... 53/376.7
4,941,309 7/1990 Fluent et al. ..... 53/544
5,024,045 * 6/1991 Fluent et al. ..... 53/544
5,054,262 * 10/1991 Hertel et al. ..... 53/382.1

* cited by examiner

*Primary Examiner*—Eugene Kim
(74) *Attorney, Agent, or Firm*—Wm. Bruce Day

(57) ABSTRACT

A unitary panel sorting and packing machine receives vinyl siding panels from an extruded production line. The machine includes a panel receiving section which includes lifting and flipper arms for selectively inverting panels for packing efficiency. From the panel receiving section, the panels are transferred to a panel accumulation section. The machine also includes a box folding section for folding corrugated paper box blanks along predetermined score lines. The box folding section is preferably parallel and adjacent to the panel receiving section and the panel accumulation section and includes retractable arms which selectively position the box in a ready position for packing panels therein. After the box is full, conveyor mechanisms carry the box from the box folding section through a box lid glue applying station and then into a box end folding and gluing station. This machine can substantially reduce repetitive stress caused injury to the operator.

9 Claims, 8 Drawing Sheets

SIDING SORTING AND PACKING ARRANGEMENT

FIELD OF INVENTION

This invention relates to production line machinery for sorting and packing articles, and in particular to such a machine for sorting and packing vinyl siding panels.

BACKGROUND OF THE INVENTION

Vinyl siding is popularly used as a substitute for clapboard siding and has the advantage of low maintenance and high resistance to weathering. Vinyl siding is easily applied by home remodelers and do-it-yourselfers. This siding is made by a known extrusion process with a common panel size of 8 inches wide by 12 feet long, although other lengths and widths can be used as appropriate. The siding is normally formed with a hanger strip along one edge which interlocks with a mating strip along the edge of an adjoining strip. These hanger strips complicate packing the strips in stacks within a box or carton, and to achieve maximum space efficiency, the strips are normally alternated in orientation. Moreover, stacking and packing of the panel strips is done by hand in most manufacturing plants. Repetitive hand and wrist movement is required, which can lead to repetitive stress injury. The panel strips are stacked in boxes or cartons which are then sealed and routed for shipment. The boxes arrive at the manufacturing plant as flat, corrugated blanks which have predetermined score lines along which the blanks are folded. The boxes are normally assembled by hand, and because the corrugated board is quite stiff, folding the boxes is another source of repetitive stress injury to the hands and wrists of the operator.

Various attempts have been made to automate the siding sorting and packing process, including those disclosed in U.S. Pat. Nos. 4,941,309 and 5,024,045 to CertainTeed Corporation. These disclose separate machines that prefold boxes from corrugated blanks but which still require significant amounts of hand work.

Accordingly, the objects of the present invention are: to provide a combined siding sorting and box folding machine that automatically folds and positions a box adjacent a siding panel receiving station; to provide such a machine that is able to selectively orient siding panels for saving space within the box; to provide such a machine which is able to seal boxes once they are filled; and to provide such a machine that is compact and well suited for the task.

Other objects and advantages of the invention will become apparent from the following description taken in connection with the drawings which disclose an exemplary embodiment of the present invention.

SUMMARY OF THE INVENTION

A unitary vinyl siding sorting and packing machine includes a panel receiving section positioned in line with a panel strip extrusion production line combined with a box folding section. The panel receiving section and box blank folding section are positioned parallel and generally adjacent to each other for minimal operator hand movement. Vinyl siding panels are deposited on a panel accumulation section platform and several panels are allowed to accumulate. The accumulated panels are then moved toward an open box by slide carriers in the platform and the operator completes the movement of the panels into the open box which has been readied for receipt of the panels. The panel receiving section includes lifting and flipping arms which can be selectively actuated to invert selected panels for efficient stacking of panels within the box. The box blank folding section folds and positions a box for most efficient stacking and minimal hand movement. Extensible arms form a carrier for holding a flat box blank and the carrier retracts, folding the box and positioning it partially under the panel receiving section to minimize hand movement. The box lid is held open in this position. After the box is filled by the operator and the lid closed, a switch is actuated and a conveyor moves the box downstream through stations which hold the box lid closed and glue it down. The filled box next passes into a box end folding and gluing station which accurately positions the box and smoothly secures the box end flap.

DESCRIPTION OF THE PREFERRED EMBODIMENT

Figure 1:
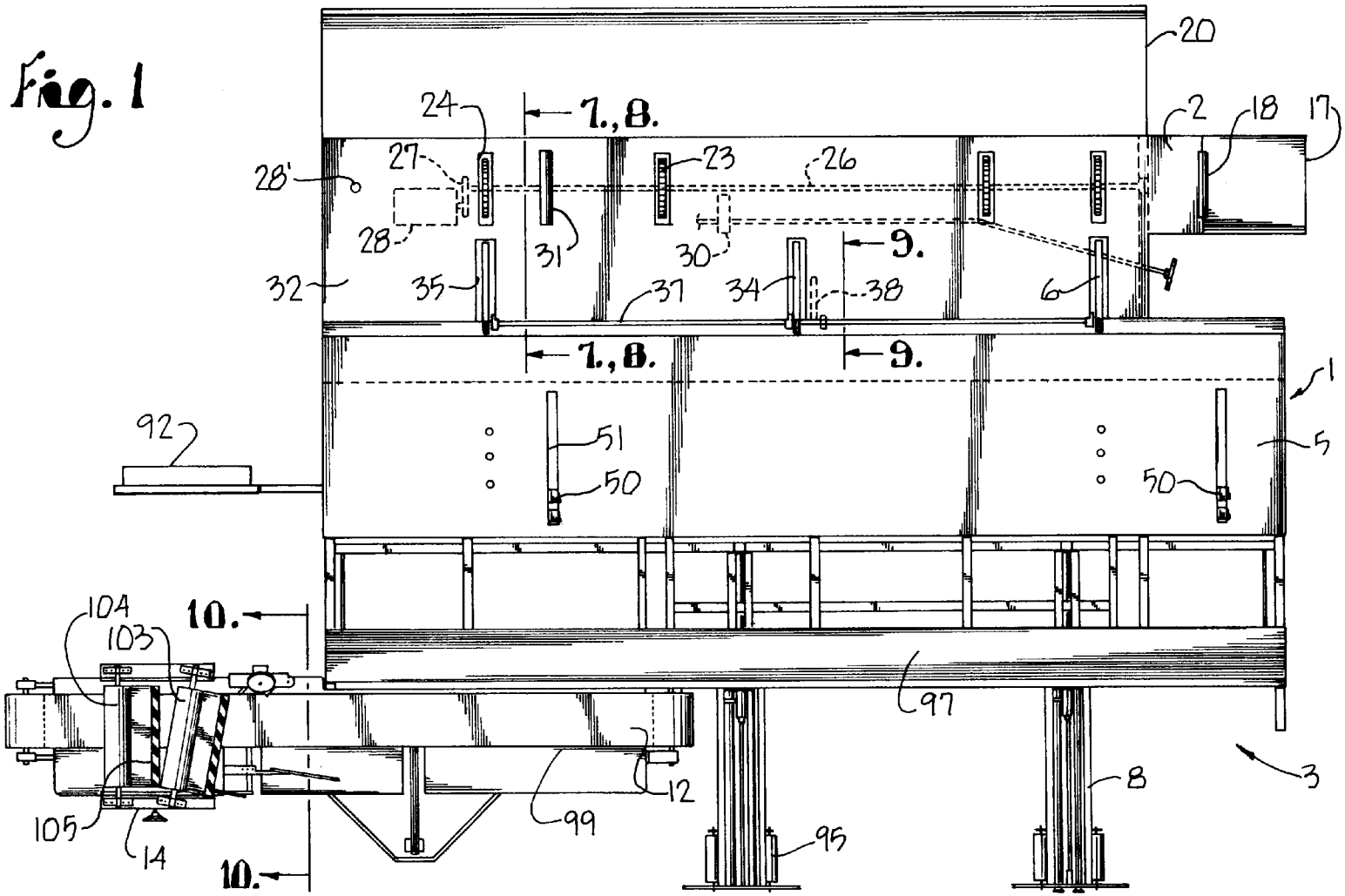
FIG. 1 is a plan view of a sorting and packing arrangement for siding panels embodying the present invention.
Figure 2:
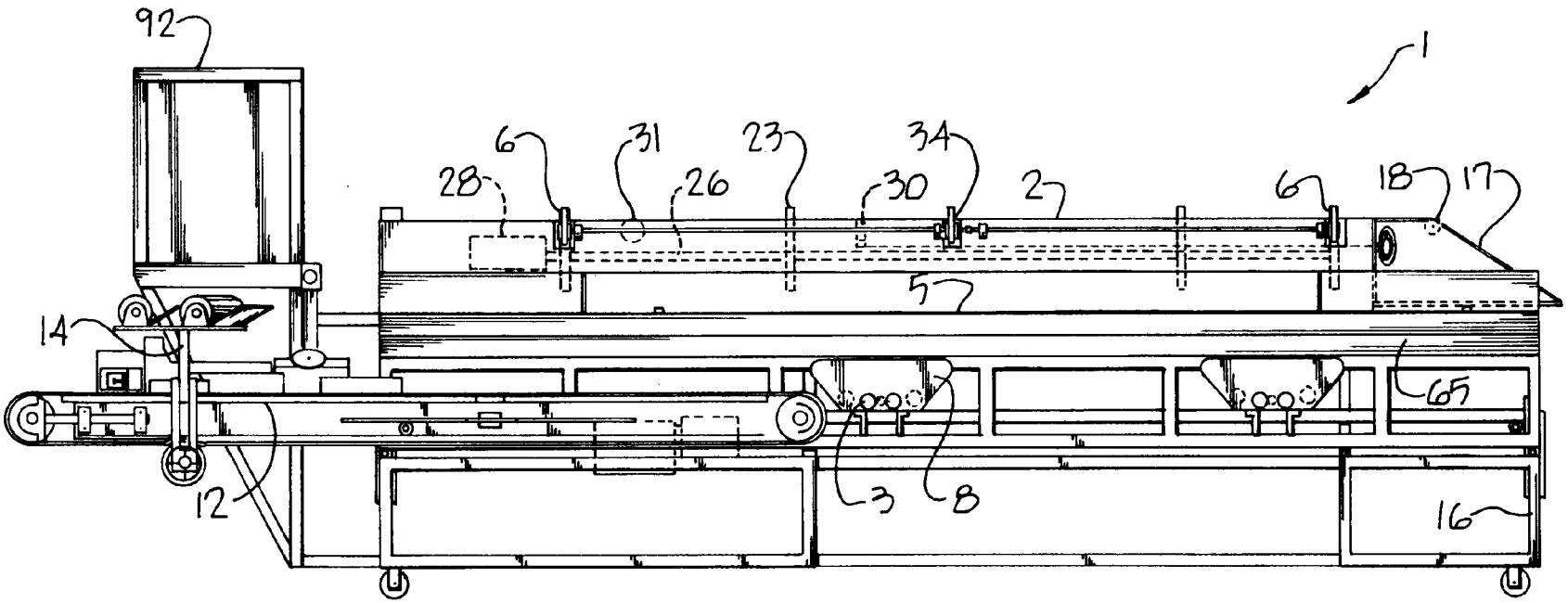
FIG. 2 is front elevational view of the sorting and packing arrangement.

As required, a detailed embodiment of the present invention is disclosed herein; however, it is to be understood that the disclosed embodiment is merely exemplary of the invention which may be embodied in various forms. Therefore, specific structural and functional details disclosed herein are not to be interpreted as limiting, but merely as a basis for teaching one skilled in the art to variously employ the present invention in virtually any appropriately detailed structure.

Figure 5:
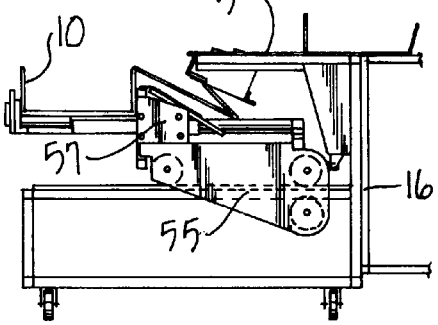
FIG. 5 is a side elevational view in sequence to FIG. 4 and showing the arrangement with a box blank in position to receive siding panels.

Referring to the drawings in more detail:

The reference numeral 1, FIG. 1, generally refers to a sorting and packing arrangement or machine for siding panels embodying the present invention. The machine 1 generally includes a panel receiving section 2 positioned in line with a panel strip production line, which is not shown and would normally be positioned to the right of the machine shown in FIG. 1. The machine 1 includes a box folding section 3. Vinyl siding panels accumulate in the panel receiving section 2 and are shifted to a panel accumulation section 5 positioned parallel and directly adjacent the box blank folding section 3. The accumulated panels are then slid by a carrier further sidewardly and into position for immediate hand movement into an open box which has been readied for receipt of the panels. The panel receiving section 2 includes flipping arm assemblies 6 which can be selectively actuated to invert selected panels for most efficient stacking of the panels within the box. Extensible arms form a carrier 8 for holding a flat box blank 9, FIG. 3. As shown in FIG. 5, the carrier 8 retracts, folding the box blank 9 into a box 10 and positioning the box 10 partially under the panel accumulation section 5 to minimize hand movement. After the box 10 is filled by the operator and the box lid is swung closed, a switch is actuated to cause a conveyor 12 to move the filled box downstream and through a box lid gluing station 14. The box is next conveyed to a box end gluing station 16, FIG. 12, which accurately positions the box and smoothly secures the end flaps.

Figure 7:
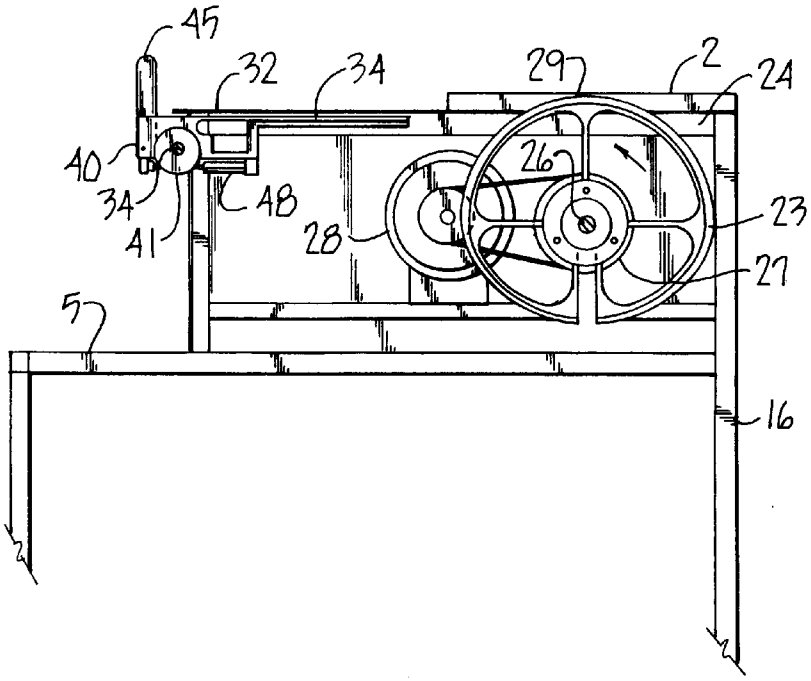
FIG. 7 is a sectional view taken along lines 7—7, FIG. 1 and showing flipping arms in a first, retracted position.

In greater detail, the sorting and packing arrangement 1 has an open frame 16 supporting the panel receiving section 2, which is generally formed of a planar length of stainless sheet material. A ramp up 17 leads into the section 2 for smooth entry of siding panel strips, facilitated by a roller 18. As the siding panel strip arrives in the panel receiving section 2, panels rejected by the operator for quality control may be manually shoved rearwardly or mechanically shifted rearwardly to fall into a reject tray 20. A rack and pin lock latch 21, FIG. 3, operates to vary the tilt of the reject tray. As the strips arrive, they are shifted laterally forwardly or rearwardly by the selective rotation of eccentric wheels 23 which are mounted below the panel receiving section 2, FIGS. 7 and 8, and which extend upwardly through slot opening 24 during a portion of their rotation. The eccentric wheels 23 are mounted on a common shaft 26 on one end of which is a pulley 27 belt driven by a motor 28. A photo electric eye 28' conveniently placed below the panel receiving section 2 causes the motor 28 to rotate the wheels 23, causing the rim of the wheel 23 to extend through the opening slots 24 and lift the siding strip, causing it to shift laterally. A selector switch adjacent the operator on a control panel 92 selects the direction of rotation of the motor to cause selection in the direction of shift of the siding strips. The wheel rim 29 has a non-skid rubber surface to facilitate gripping. A second roller 31 in the table surface aids longitudinal travel of the siding strips. As shown in FIG. 1, an adjustable position sensor 30, such as an electronic eye may be mounted on a screw shaft and electrically connected to a controller (not shown) for the siding extrusion machine located upstream of the sorting and packing arrangement 1. The sensor could be used in the control of the length of the siding strip.

Figure 8:
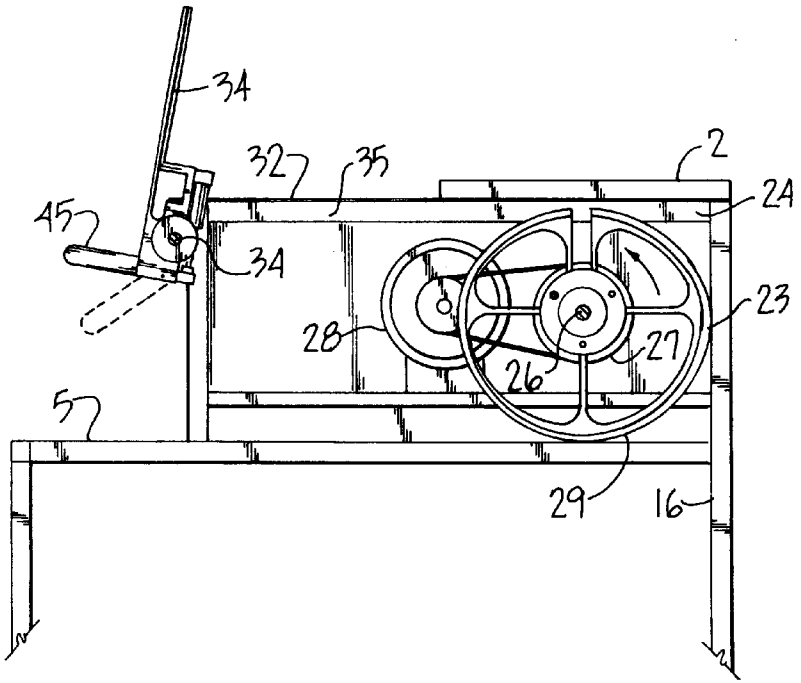
FIG. 8 is a sectional view taken along lines 8—8, FIG. 1 and showing the flipping arms in a second, lifting position.
Figure 9:
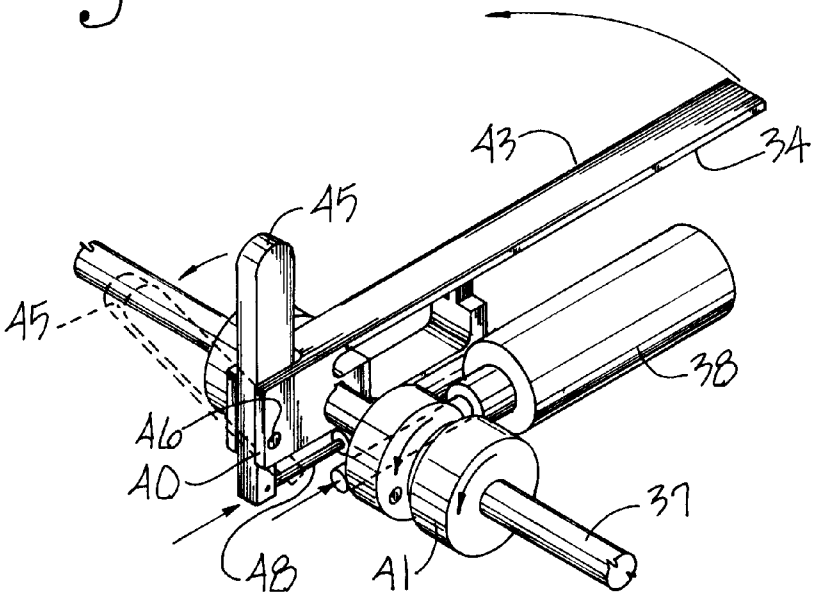
FIG. 9 is a perspective view of the flipping arm mechanism shown in FIGS. 7 and 8.

Located adjacent, parallel to and forming part of the panel receiving section 2 is a panel transfer area 32 of the section 2 which receives siding strips as they are shifted laterally from the eccentric wheels 23 and from where the strips are transferred to the panel accumulating section 5. The panel accumulating area 5 is likewise formed of stainless sheet material and is positioned at a level below that of the panel receiving section 2. A plurality of lifting arms 34, such as three, FIGS. 7, 8, and 9, extend selectively upwardly through slots 35 and carry individual siding panels to deposit them in the panel accumulating area 5. Each lifting arm 34 is an assembly that swings upwardly on a common shaft 37 which is rotated by a pneumatic cylinder actuator 38 located adjacent the middle positioned lifting arm, FIG. 1. Each lifting arm assembly 34 includes a mounting block 40 secured on the shaft 37 for rotation therewith. Bearings 41 adjacent each of the lifting arm assemblies 34 and mounted within brackets (not shown) provide support. Each lifting arm assembly 34 has an elongate arm 43 which, when the lifting arm assembly 34 is actuated, swings upwardly to carry a siding strip transferred to it from the eccentric wheels 23 and deposit the siding strip into the panel accumulation section 5. The siding strips may simply slide off the arms 43 and land in the same orientation or may be inverted to land upside down in alternated manner for most efficient stacking and conservation of space. To flip the siding strips, the lifting arm assemblies 34 include flipping arms 45 secured to the mounting block 40 by a pivot pin 46 and swung by a pneumatic cylinder actuator 48 which is selectively actuated by a control switch (not shown) at the operator's position. The actuator 48 swings the flipping arm 45 as shown in FIGS. 8 and 9. When in the perpendicular position to the lifting arm 43, the flipping arms 45 cause siding strips to flip and land upside down on the panel accumulating section 5 when the lifting arms 43 are swung upwardly. Conversely, when the actuator 48 is operated to swing the flipping arm 45 into an angle greater than 90 degrees relative to the lifting arm 43, the siding strip slides off the lifting arm 43 and does not invert.

The siding strips accumulate in stacks in the panel accumulation section 5 and may be positioned right side up or alternatively inverted for most efficient stacking. The panel accumulation section 5 also has a smooth stainless steel or other appropriate surface and includes slide carriers 50 traveling in slots 51 which move the accumulated stacks of siding strips forwardly. The slide carriers 50 are moved by pneumatic actuaters (not shown).

Figure 4:
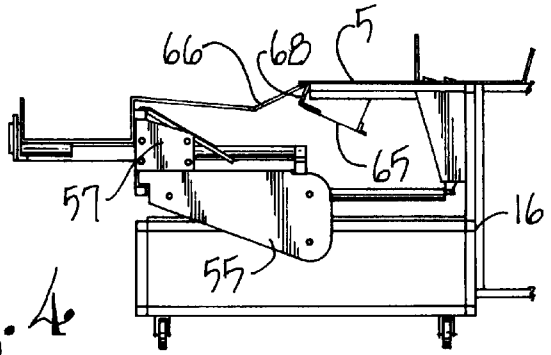
FIG. 4 is a side elevational view in sequence to FIG. 3 and showing the arrangement with a partially folded box blank.
Figure 3:
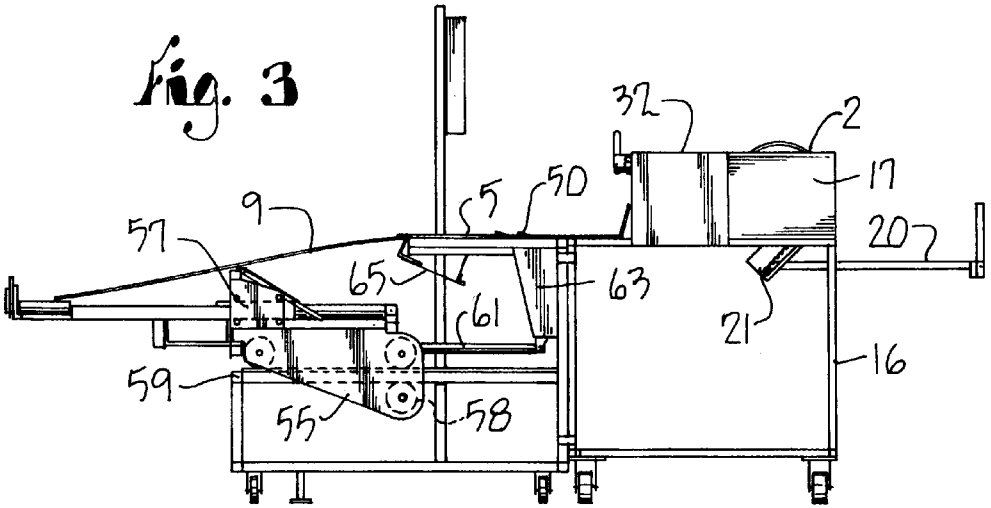
FIG. 3 is a side elevational view taken from the right side as shown in FIG. 1 and showing the arrangement receiving an unfolded box blank.

As shown in FIGS. 3, 4 and 5, the panel accumulation section 5 is open underneath and a portion of the packing carton or box 10 such as the lid is positionable under the section 5 for ease of loading. To accomplish this, pairs of slide assemblies 55 are mounted on a support frame 57 connected to the frame 16. The support frame 57 has rollers 58 positioned above and below an upper frame member 59 for forward and aft movement. An actuator 61, such as a pneumatic ram, extends between the support frame 57 and a holding bracket 63 affixed to the frame 16 so that upon extension of the actuator, the support frame moves outwardly, or toward the operator.

Above the support frame 57 is mounted a deflector panel 65 which runs the length of the panel accumulating section 5 and is similarly formed of sheet metal. The deflector panel 65 is angled rearwardly and downwardly so that a flap portion 66 of the box blank 9 rests thereagainst as the blank is folded. The deflector panel 65 includes a lip 68 which forms a catch angle with the front lip of the panel accumulation section 5 in order to catch and hold the box blank edge as it is initially positioned for folding, FIG. 3.

Figure 6:
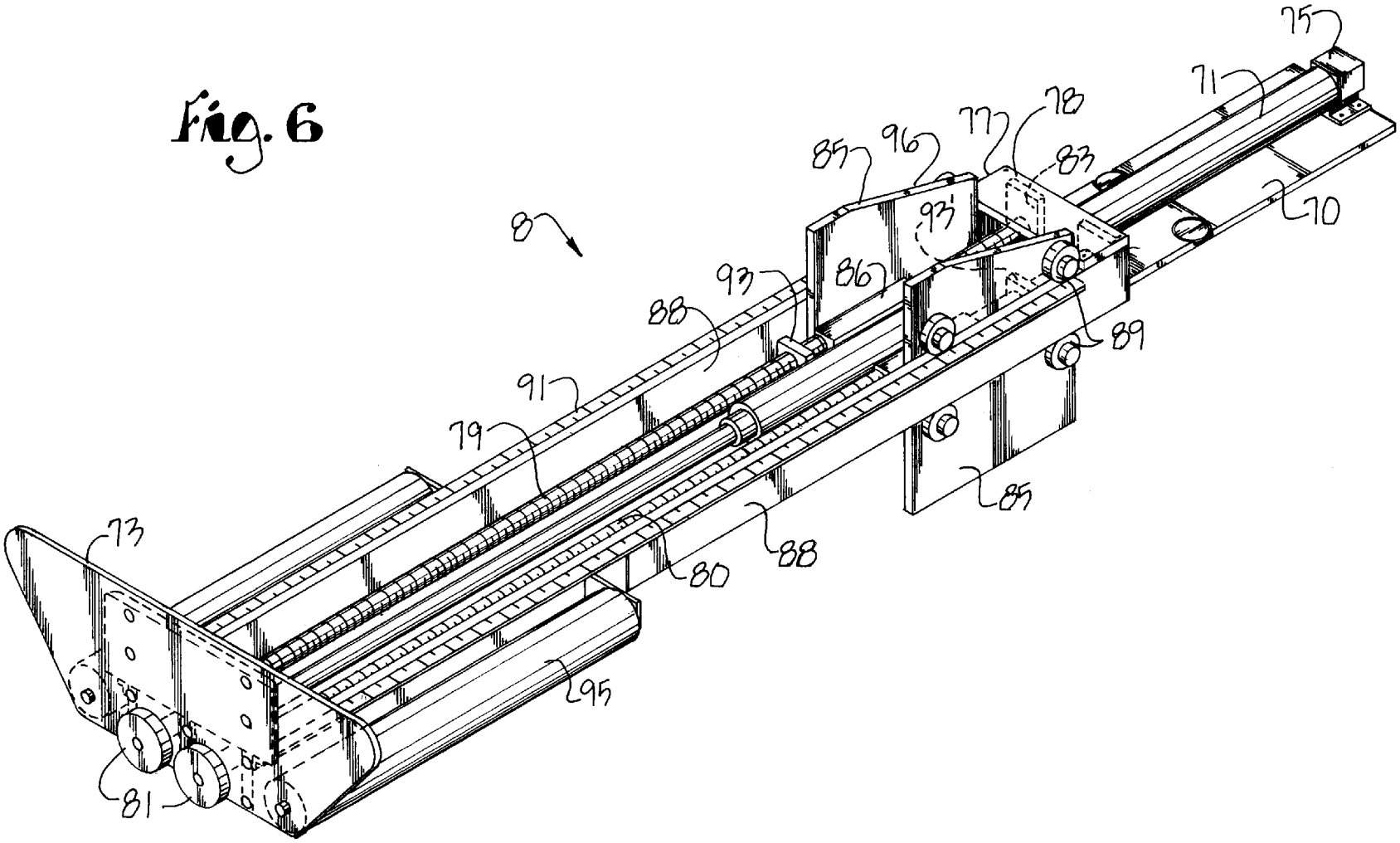
FIG. 6 is a perspective view showing an adjustment and stop mechanism for controlling box blank folding sub assemblies.

The support frame 57 supports the carrier 8 into which the box blank 9 is positioned for folding and packing. Referring to FIG. 6, the carrier 8 is preferably adjustable so that different sizes of boxes may be accommodated or adjustments can be made for tolerances in blanks. The carrier 8 includes a fixed base plate 70 extending longitudinally and mounting a telescoping rod 71. The rod 71 extends between an outer end plate 73 sideably mounted on the end of the rod 71 and an inner, fixed mount 75. A slide plate 77 is positioned above the base plate 70 and is moveable thereover, also fitting over the rod 71. First and second threaded rods 79 and 80 provide means for adjustment of inner and outer movement and terminate at outer ends in adjustment knobs 81 located on the outer end plate 73 and terminating at inner ends in free spinning end plates 83 affixed to a mount 78 moving above plate 70. Spaced side plates 85 are affixed to the framework 57 and hold the carrier 8 in position. Guides 86 are affixed to the side plates 85 and through which extend the respective threaded rods 79 and 80. Side rails 88 extending forwardly from the mount 78 via wheels 89 positioned above and below the rails 88. The rails have scales 91 for measurement of adjustment. The first rod 79 extends through a threaded stop 93 which hits against the front edge of the side plate 85 for limiting retraction movement of the carrier 8. The second rod 80 extends through a threaded stop 93' which hits against the rear edge of the side plate 85 for limiting extension movement of the carrier 8. Together, the rods 79 and 80 provide forward and rearward adjustability of the carriage 8. The rod 79 provides rearward or retraction adjustment whereas the rod 80 provides forward or extension adjustment for proper folding of the box blank 9. Rollers 95 mounted adjacent the respective rails 88 adjoining the outer end plate 73 extend slightly above the level of the rails 88 and facilitate a loaded box 10 to be conveyed downstream, joining with the conveyor 12 and moving the box 10 through the box lid gluing station 14.

A control panel 92 is mounted to extend from an end of the machine 1 for containing electrical power and control circuits, circuit breakers and the like.

In operation, the carriage 8 is moved outwardly to the position shown in FIG. 3 and a box blank 9 laid in position by an operator so that one side margin is adjacent to the outer end plate 73 and the other is engaging the lip 68. The side plates 85 extend upwardly a distance less than the height of the box side wall and have a slanted top edge 96 of the same general angle as that of the deflector panel 68. A sheet metal panel 97, FIG. 1, is mounted across the top edges 96 and extends the length of the panel accumulation section 5. After the operator places the box blank 9 as shown in FIG. 3, the operator actuates a switch to cause retraction of the carriage 8, meanwhile lightly pushing downwardly on the blank 9 in the area between the outer end plate 73 and the side plates 85. As the carriage 8 retracts, the blank 9 folds along its crease lines to the intermediate position shown in FIG. 4. Another switch is actuated to cause retraction of the support frame 57 under the panel accumulation section 5 to complete the box folding, as shown on FIG. 5. In this relation, hand movement by the operator is minimized and there is less likelihood of repetitive stress injury. The carriage 57, with minimal assistance from the operator, folds the box blank 9 into an open position ready to receive siding strips, FIG. 5.

Figure 10:
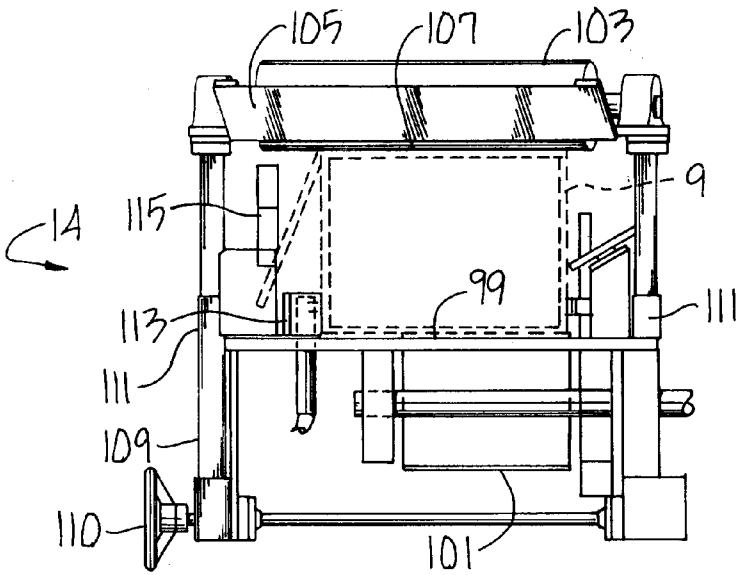
FIG. 10 is a cross sectional view of the box lid sealing station taken along lines 10—10, FIG. 1.

In the strip receiving position shown in FIG. 5, the box 10 and carriage 8 is longitudinally aligned with the conveyor 12 which transfers the loaded box 10 from the strip receiving position to the box lid gluing station 14. The conveyor 12, in the illustrated example, has a carrier belt 99 driven by a motor, FIG. 10, located under an outlet end of the conveyor 12. The box lid gluing station 14 is generally located adjacent an outlet end of the conveyor 12 and includes first and second top rollers 103 and 104 each preceded by a press down ramp 105 which initially urges the box lid 107 downwardly with the respective roller 103 and 104 applying still more downward pressure. The first roller 103 is angled off perpendicular whereas the second roller 104 is perpendicular to the line of travel of the conveyor 12; this arrangement smooths the box lid 107 downwardly. A vertical height adjustment mechanism 109, FIG. 10, includes a hand wheel 110 which acts upon threaded shafts running through tubes 111 to vary the height of the rollers 103 and 104 and therefore control the pressure applied to the box lid 107. The box 10 passes through the box lid gluing station 14, which includes a glue head 113 positioned upstream of a movable side plate 115. The glue head 113 applies hot glue to the sidewall of the box underlying the lid 107 and the movable side plate 115 next presses the lid 107 down and into contact with the glued sidewall.

Figure 11:
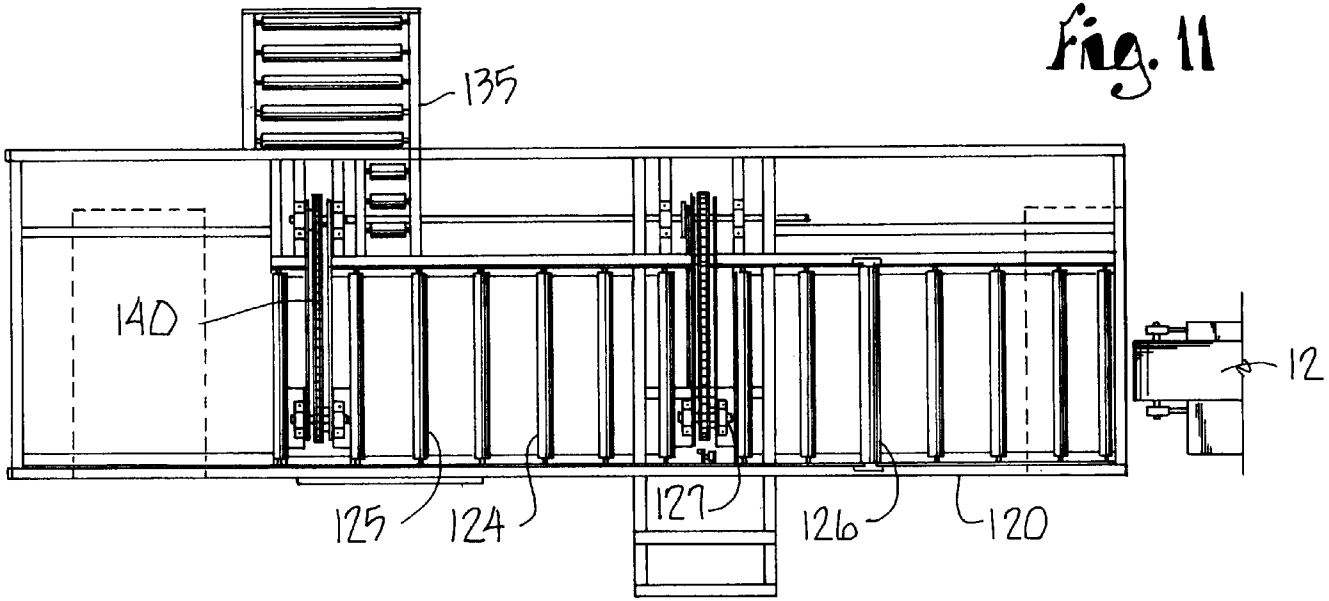
FIG. 11 is a plan view of a conveyor which transports the boxes containing stacks of panels from the box lid sealing station shown in FIG. 10 to a box end sealing station.
Figure 12:
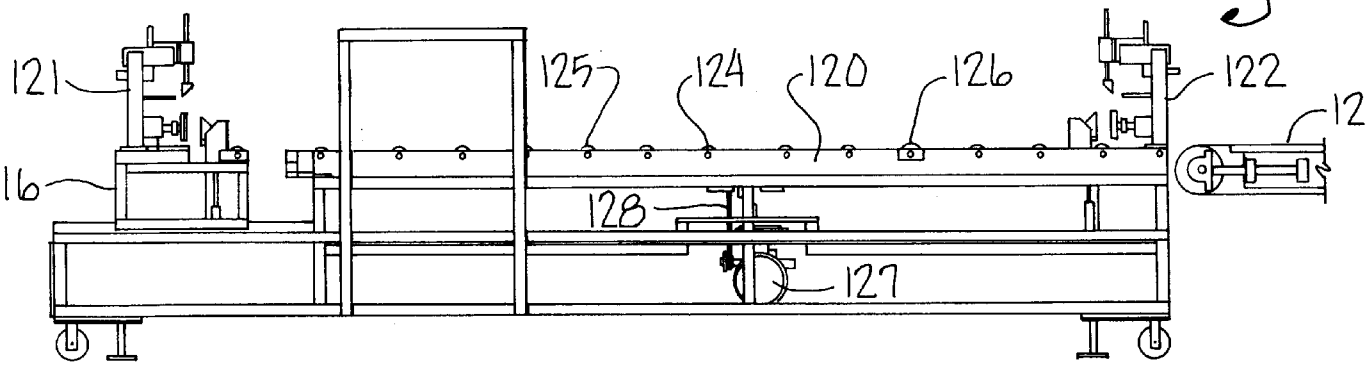
FIG. 12 is a front elevational view of the conveyor shown in FIG. 11 and showing the box end sealing station.

From the conveyor 12, the box 10 next travels to a box end gluing station 120, FIGS. 11 and 12, which includes spaced box end gluing devices 121 and 122. The box end gluing station 120 substantially consists of a conveyor 124 which in the illustrated example, is a free conveyor formed of a multiplicity of rollers 125 and the opposed box end gluing devices 121 and 122. One of the rollers 125 such as the roller 126 may be powered by a drive motor (not shown) inside the roller for rotation.

From the box end gluing station 120, a loading free conveyor 135 routes sidewardly for stacking the filled boxes or transfer to a loading dock area. To move the boxes 10 to the loading conveyor 135, the conveyor 124 has several laterally extending chains 140 driven by a motor 127 which shift the box 10 sidewardly. A photo eye 141 located in the box end gluing station 121 senses the position of the box 10 and actuates the motor 127 to drive the chains 140 and shift the box 10 sidewardly.

Figure 14:
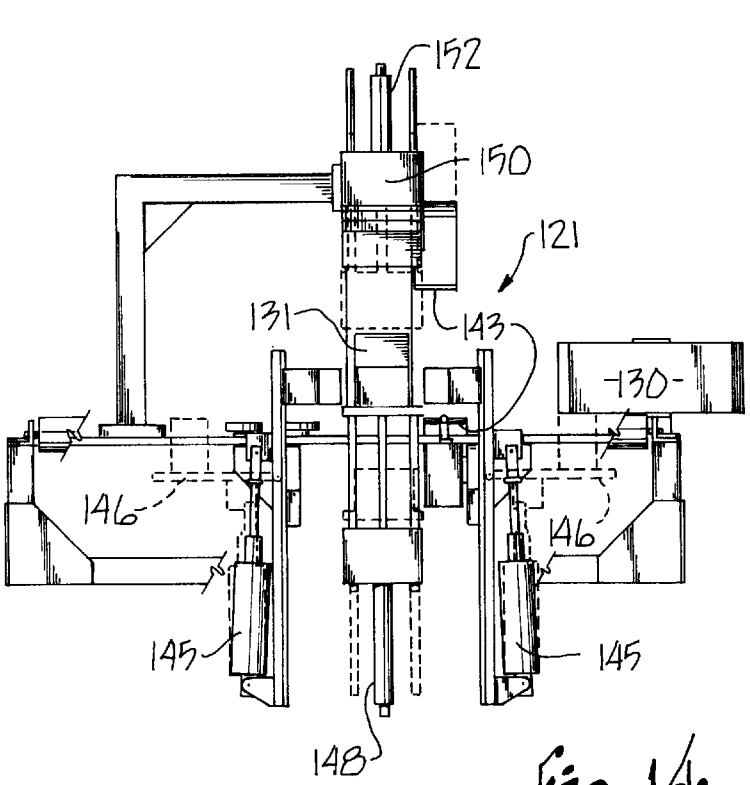
FIG. 14 is an end elevational view of the box end sealing station.
Figure 13:
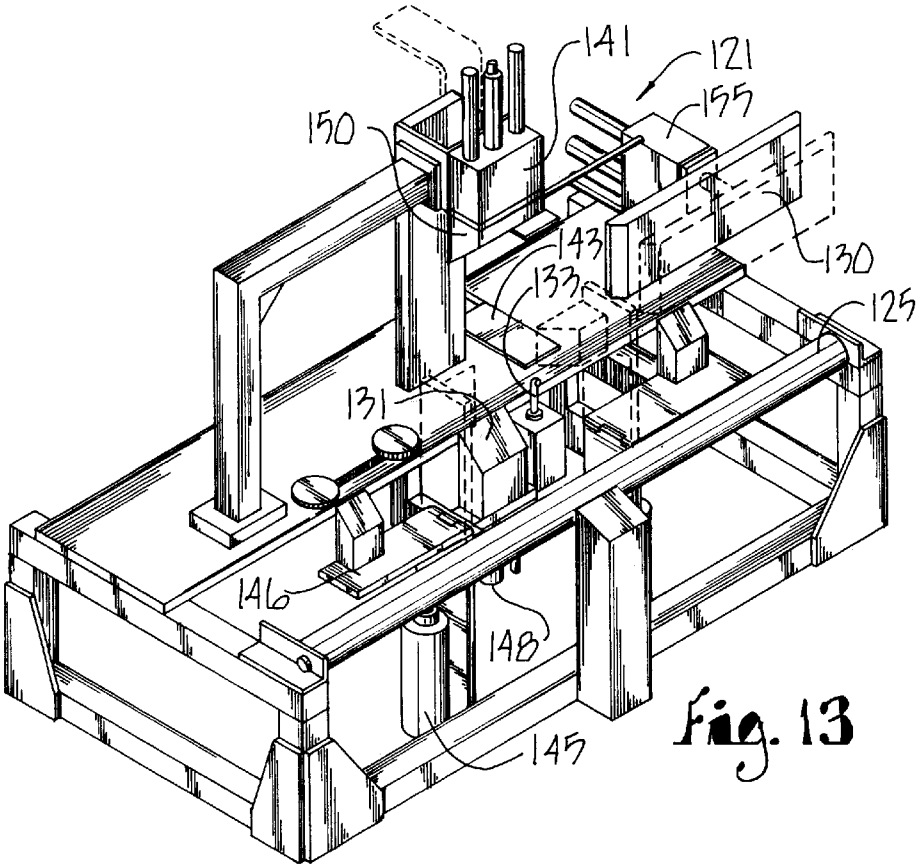
FIG. 13 is a perspective view of the box end sealing station.

FIG. 11 shows the box end gluing station 120 without the box end gluing devices 121 and 122 for purposes of illustration. Turning to FIG. 12, the box end gluing devices 121 and 122 are located on opposite ends of the box end gluing station 120 in order to glue the opposite ends of the box 10 as it is received in the gluing station 120 and shifted sidewardly therein. Box end gluing device 121 and 122 is the same with reference to FIGS. 13 and 14 for purposes of illustration. Each box end gluing device 121 or 122, FIGS. 13 and 14, includes pusher members 130, 131, 146 and 150 and a glue head 133 to apply glue to the box end flap and push it closed.

Upon reaching the gluing device 121 or 122, flap openers 143 rotate and pull open the box end flap at the top and bottom. Next, air cylinders 145 extend to swing respective closer arms 146 upwardly to close the box side, or minor flaps. Then, a bottom thruster 131 moves upwardly by action of air cylinder 148 to close the box bottom flap and the side closer arms 146 swing downwardly. Upper thruster 150 extends downwardly by action of air cylinder 152 to partially close the box upper flap as the bottom thruster 131 retracts. The box 10 next moves sidewardly by action of the laterally extending chains 140 to drive the box past the glue head 133 to apply hot glue to the box end. After the glue is applied, pusher members 130 extend via air cylinder 155 to push the upper end flap closed against the underlying glued surface. The chains 140 stop for a short time to permit the glue to cure and then start again to move the sealed box 10 outwardly, at which time the pusher members 130 retract simultaneously.

While the invention has been illustrated and described in its preferred form, it will be apparent that the invention is subject to alteration and modification without departing from the underlying principles involved, and the invention is not limited to its specific details illustrated and described except insofar as set forth in the following claims.

What is claimed and desired to be secured by Letters Patent is:

1. A unitary panel packing and folding machine for facilitating folding corrugated paper box blanks along predetermined score lines and depositing panels into the box, said machine comprising:

a) a panel receiving section for positioning in line with a panel extrusion production line; and b) a box folding section positioned generally adjacent said panel receiving section, said box folding section having means for folding a corrugated paper box blank along predetermined score lines to form a container for receiving panels from said panel receiving section.

2. The panel packing machine set forth in claim 1 wherein said panel receiving section includes flippers for inverting selected ones of said panels for stacking said panels atop each other.

3. The panel packing machine set forth in claim 1 wherein said box folding section includes arms extending outwardly from adjacent said panel receiving section to hold said box blank, said arms being retractable to cause said box blank to fold along said score lines.

4. The panel packing machine set forth in claim 1 including conveyor means adjacent said box folding section for transporting a folded and full box from said panel packing machine.

5. A panel packing machine for facilitating folding corrugated paper box blanks along predetermined score lines and depositing panels into the box, said machine comprising:

a) a panel receiving section for positioning in line with a panel extrusion production line;

b) an operator's station located in front of said panel receiving section;

c) a box folding section positioned adjacent said panel receiving section and having a platform for receiving a box blank, said box folding section including extensible members for folding said box blank along said score lines into a box and positioning said box against said panel receiving section for placement of said panels therein.

6. The panel packing machine set forth in claim 5 including box flap gluing means positioned downstream from said box folding section.

7. The panel packing machine set forth in claim 6 including box end gluing means positioned downstream from said box folding section.

8. A panel sorting and packing machine for facilitating folding box blanks comprising:

a) a panel receiving section for positioning in line with a panel extension production line;

b) a box folding section positioned adjacent said panel receiving section, and said box folding section including arm means for receiving a box blank and folding said box blank along predetermined fold lines to form a container for receiving panels from said panel receiving section, said arm means extending outwardly from said panel receiving section and having end abutments for cradling said box blank between said end abutments and said panel receiving section and said arm means being retractable to position an open lid of a folded box blank at least partially under said panel receiving section.

9. A panel sorting and packing machine for facilitating folding box blanks and comprising:

a) a panel receiving section for positioning in line with a panel extrusion line;

b) a panel accumulation section situated sidewardly adjacent said panel receiving section;

c) a box folding section situated sidewardly adjacent said panel accumulation section;

d) means for shifting a panel sidewardly in said panel receiving section;

e) means for selectively flipping over said panel from said means for shifting a panel sidewardly and moving said panel to said panel accumulation section;

f) means for shifting said panel sidewardly in said panel accumulation section;

g) said box folding section including extensible arm means having end abutments to receive a box blank and retractable to fold said box blank against said panel accumulation section to form a box positioned sidewardly thereof and open to receive said panel; and h) means for securing open portions of said box to form a closed container.

* * * * *